US010500701B2

(12) United States Patent
Kegg et al.

(10) Patent No.: US 10,500,701 B2
(45) Date of Patent: Dec. 10, 2019

(54) SPANNER WRENCH

(71) Applicant: Horizon Systems Machining, Inc., Kenosha, WI (US)

(72) Inventors: Angel James Kegg, Kenosha, WI (US); James Alan Wright, Kenosha, WI (US)

(73) Assignee: Horizon Systems Machining, Inc., Kenosha, WI (US)

( * ) Notice: Subject to any disclaimer, the term of this patent is extended or adjusted under 35 U.S.C. 154(b) by 214 days.

(21) Appl. No.: 15/585,850

(22) Filed: May 3, 2017

(65) Prior Publication Data

US 2018/0318987 A1 Nov. 8, 2018

(51) Int. Cl.
*B25B 13/50* (2006.01)
*B25B 13/10* (2006.01)

(52) U.S. Cl.
CPC ..... *B25B 13/5008* (2013.01); *B25B 13/10* (2013.01); *B25B 13/5016* (2013.01)

(58) Field of Classification Search
CPC .. B25B 13/5008; B25B 13/10; B25B 13/5016
USPC ..... 81/176.1
See application file for complete search history.

(56) References Cited

U.S. PATENT DOCUMENTS 582,238 A 5/1897 Schrader
1,314,044 A * 8/1919 Buker ..... B25B 13/102 269/283
1,405,207 A 1/1922 Guerrero
2,386,254 A 10/1945 Meyer
2,619,861 A 12/1952 Wanamaker
2,712,259 A 7/1955 Cowell
2,720,127 A 10/1955 Bonniwell
2,830,480 A 4/1958 Brame
2,847,888 A 8/1958 Paulson
2,956,461 A 10/1960 Anderson
2,991,676 A 7/1961 Bond
2,991,677 A 7/1961 Savarin
(Continued)

FOREIGN PATENT DOCUMENTS

CN 201325015 10/2009
CN 201399752 2/2010
(Continued)

OTHER PUBLICATIONS

PCT Search report for related application; Int'l Appl. No. PCT/US2017/032407, dated Sep. 14, 2017.

*Primary Examiner* — Hadi Shakeri
(74) *Attorney, Agent, or Firm* — Jansson Munger McKinley & Kirby Ltd.

(57) ABSTRACT

A spanner wrench assembly including a base plate having a gripping portion extending from a handle portion and defining an arcuate cavity with an open end. At least one support plate is secured to the gripping portion and substantially matches a configuration of the arcuate cavity. The support plate is of a lesser density material than the base plate. An engagement plate substantially matches the configuration of the arcuate cavity and is secured with respect to the at least one support plate. A cover defines one elongate aperture extending to an open mouth portion formed by an adjacent end of the cover, and another elongate aperture extending to a closed mouth portion dimensioned to accept a connector head which is wider than the elongate apertures.

18 Claims, 15 Drawing Sheets

(56) References Cited

U.S. PATENT DOCUMENTS

| | | | | |
|---|---|---|---|---|
| 3,063,315 | A | 11/1962 | Bernor et al. | |
| 3,320,835 | A | 5/1967 | Flory et al. | |
| 3,407,689 | A | 10/1968 | Slayton | |
| 3,709,073 | A * | 1/1973 | Kurtz | B25B 13/08 76/114 |
| 3,712,698 | A * | 1/1973 | Propst | A47B 57/00 312/306 |
| 3,731,560 | A | 5/1973 | Bares | |
| 3,897,701 | A | 8/1975 | Daniels et al. | |
| 3,900,938 | A | 8/1975 | Blomgren, Sr. et al. | |
| 3,985,050 | A | 10/1976 | Lurie | |
| 4,227,429 | A * | 10/1980 | Bowers, Jr. | B25B 13/06 81/176.15 |
| 4,466,315 | A | 8/1984 | Boschetto, Jr. et al. | |
| 4,483,220 | A | 11/1984 | Shindelar | |
| 4,570,514 | A | 2/1986 | Schoener | |
| 4,676,126 | A | 6/1987 | Polstri | |
| 4,848,195 | A | 7/1989 | Hockenbery | |
| 5,172,612 | A | 12/1992 | Hansson | |
| 5,216,941 | A | 6/1993 | Kolvereid | |
| 5,257,556 | A | 11/1993 | Pineault | |
| 5,347,891 | A | 9/1994 | Kamp et al. | |
| 5,442,845 | A | 8/1995 | Gilbert | |
| 5,469,766 | A | 11/1995 | Hodges | |
| 5,480,271 | A | 1/1996 | Jorgensen et al. | |
| 5,890,404 | A | 4/1999 | Stojanowski | |
| 5,906,147 | A | 5/1999 | Price | |
| 6,110,067 | A | 8/2000 | Nuttall | |
| 6,530,298 | B1 | 3/2003 | Steffe | |
| 7,114,417 | B1 | 10/2006 | Dring | |
| 8,833,209 | B2 * | 9/2014 | Brown | B25B 13/10 81/90.1 |
| 9,193,044 | B2 | 11/2015 | Cheng | |
| 9,289,894 | B2 | 3/2016 | Johnson et al. | |
| 2002/0139225 | A1 | 10/2002 | Carter | |
| 2003/0200840 | A1 | 10/2003 | Yap | |
| 2008/0307929 | A1 * | 12/2008 | Lorger | B25B 13/5016 81/57.33 |
| 2010/0018083 | A1 | 1/2010 | Lavergne et al. | |
| 2012/0297604 | A1 | 11/2012 | Stayton | |
| 2014/0373685 | A1 | 12/2014 | Lacert | |

FOREIGN PATENT DOCUMENTS

| | | |
|---|---|---|
| CN | 101863002 | 2/2012 |
| CN | 203945298 | 11/2014 |
| CN | 204295571 | 4/2015 |
| CN | 204819286 | 12/2015 |
| CN | 204893778 | 12/2015 |
| CN | 106141969 | 11/2016 |
| FR | 1396536 | 3/1964 |
| GB | 191400275 | 7/1914 |
| WO | 2010/0002239 | 1/2010 |

* cited by examiner

SPANNER WRENCH

FIELD OF THE INVENTION

This invention relates generally to a spanner wrench assembly, and more particularly to an adjustable wrench assembly for assembling and disassembling various sizes of components.

BACKGROUND OF THE INVENTION

Industry usage of hydraulic cylinder assemblies utilizing threaded insert cylinder caps is rapidly increasing. These insert caps have external threads which mate with internal threads in the cylinder barrel. When assembled to the cylinder barrel, the insert caps must be tightened to a specified torque. A spanner type wrench is usually used to assemble and disassemble the cap and the barrel, with the wrench having engaging pins to engage slots or holes in the cap. Removal of the cap is usually very difficult due to rusting, corrosion, and denting of the cap and/or cylinder barrel. These problems increase the torque required to remove the cap, and it is very difficult to maintain engagement of the wrench with the cap slots. Installation and removal is even more difficult because the caps are usually cast, resulting in the slots having curved corners and wall surfaces having a draft angle. The use of very large pipe wrenches and chain type wrenches has been only marginally successful due to the width and overall diameter of the caps. Still another problem is that each hydraulic cylinder size requires a separate wrench to fit that particular cylinder cap.

The present invention is directed to overcoming one or more of the problems as set forth above.

SUMMARY OF THE INVENTION

The present invention relates to an improved spanner wrench assembly for installing and removing components of a structure. The inventive spanner wrench has a base plate with a gripping portion extending from a handle portion and defining an arcuate cavity with an open end. At least one support plate is secured to the gripping portion and has a configuration substantially matching that of the arcuate cavity, the at least one support plate being of a lesser density material than the base plate. An engagement plate is secured with respect to the at least one support plate and substantially matches the configuration of the arcuate cavity. The engagement plate provides locking engagement with the components that need to be disassembled from the main structure. The base plate and the support plate together form a rotation member with the handle portion serving as a lever for rotating the components such as a cap of a hydraulic cylinder.

The spanner wrench assembly may have a pair of the support plates each secured to the base plate and sandwiching the gripping portion therebetween. Each of the support plates may be of a lesser density material than the base plate, thereby reducing the total weight of the spanner wrench assembly. The base plate may be made of steel while the support plates may be made of aluminum.

The inventive configuration permits initial formation of the base plate including the gripping portion and the handle portion as a one-piece plate of a substantially consistent thickness. Such one-piece plate is free of welding or other junction formed between initially-separate gripping and handle portions. The integral one-piece has strengthened connection between the gripping and handle portions. This is in contrast with prior assemblies which have a handle welded to a cylinder to form a member with the lever for rotating the wrench assembly to disassemble a structure, such as to remove a cap of a hydraulic cylinder.

The spanner wrench assembly may have a plurality of engagement blocks, each slidably received within a slot formed in an open face of the engagement plate. The slots may be arranged such that at least one of the slots is positioned with respect to at least one other slot at one of 180°, 120°, 90°, 60° and 30° angles. There may be pairs of the slots with one slot of the pair positioned at a 180° angle with respect to the other slot of the pair. In addition or alternatively, there may be pairs of the slots with one slot of the pair positioned at a 120° angle with respect to the other slot of the pair. In addition or alternatively, there may be pairs of the slots with one slot of the pair positioned at a 90° angle with respect to the other slot of the pair. In addition or alternatively, there may be pairs of the slots with one slot of the pair positioned at a 60° angle with respect to the other slot of the pair. In addition or alternatively, there may be pairs of the slots with one slot of the pair positioned at a 30° angle with respect to the other slot of the pair.

The spanner wrench assembly may further include a locking block secured within each of the slots. The locking block may be adjustable within the slot such that the corresponding one of the engagement blocks may be substantially freely inserted into the slot. Once the engagement block is in the desired position, the locking block may be further adjusted to lock the engagement block in a fixed position within the slot.

In certain embodiments, each of the slots may be a substantially rectangular trough defined by a substantially flat bottom surface with a pair of opposite lateral surfaces extending substantially orthogonally to the bottom surface.

Each of the engagement blocks may have an engagement portion extending from a mounting portion positionable within the slot. The engagement portions of different blocks may be of different sizes to accommodate a variety of engagement cavities in components to be removed.

In certain embodiments, the mounting portion has a pair of lateral surfaces extending from a substantially flat mounting surface positionable against less than the full width of the substantially flat bottom surface of the slot. One of the lateral surfaces of the engagement-block mounting portion is substantially orthogonal to the mounting surface for positioning against one of the lateral surfaces of the slot. The other lateral surface of the engagement block may extend from the mounting surface of the block at a sharp angle.

In some of such embodiments, the locking block has one lateral surface substantially orthogonal to a bottom surface for positioning against the lateral surface of the slot opposite the orthogonal lateral surface of the engagement block. The other lateral surface of the locking block extends at an obtuse angle which substantially equals the subtraction from 180° of the sharp angle of the lateral surface of the mounting portion of the engagement block.

In order to position the engagement block within the slot, the locking block is moved away from the bottom surface of the slot. The locking block may be moved by loosening fasteners securing the locking block to the engagement plate. When the engagement block is in the desired position, the locking block is brought toward the bottom surface of the slot such that the angled lateral surfaces of the locking block and the mounting portion of the engagement block are in tight abutment, thus holding the engagement block in the fixed position within the slot.

In certain embodiments of the spanner wrench, the engagement blocks include pin-retaining blocks each defining a set of cavities with a retaining pin in each cavity. Some of such pin-retaining blocks may have a spring assembly within each cavity which includes a spring depressed by the pin locked within the cavity. When the pin is unlocked, the spring is released and pushes the pin out of the cavity beyond a front face of the pin-retaining block for engagement with the component to be removed from the structure. Alternatively, the pin may be removed from the cavity which stores the pin for positioning into the orthogonal cavity to accommodate engagement with a component that has a configuration requiring such engagement orientation.

The pin may be locked within the cavity by a locking screw which is advanced through a lateral wall of the block into the cavity until engagement with the pin. The pin is unlocked by retrieval of the locking screw from the cavity.

In certain embodiments, the spanner wrench assembly includes a cover plate for closing the open end of the arcuate cavity. In some embodiments, the cover plate defines a pair of spaced apart elongate apertures. Each of the apertures is dimensioned to accept a stem of a corresponding one of a pair of connectors extending from one of the base and support plates. One of the elongate apertures may extend to an open mouth portion formed by an adjacent cover-plate end. Another of the elongate apertures may extend to a closed mouth portion dimensioned to accept a connector head which is wider than the elongate apertures.

For securing the cover plate with respect to the base and support plates to close the arcuate cavity, the cover plate is slid against end surfaces of the base and support plates such that the connector head is at a cover-plate surface opposite a work surface of the cover plate abutting the end surfaces of the base and support plates.

In some versions, both apertures may have a key-hole shape with a wider mouth portion dimensioned to accept the head of the connector and a narrower elongate portion of the aperture dimensioned to accept the stem of the connector, thereby securing the cover plate with respect to the base and support plates In some embodiments, the narrow elongate portion of the elongate apertures is formed through less than the full thickness of the cover plate with the remaining thickness being formed into an elongate cavity dimensioned to accept the connector head. Such configuration forms a ledge within the elongate aperture with the connector head being recessed within the cover plate against such ledge when the cover plate is secured against end surfaces of the base and support plates to close the arcuate cavity.

Some embodiments of the spanner wrench assembly further include a retainer at the cover-plate work surface. The retainer can be pressed into the cover plate by abutment of the cover-plate work surface and end surfaces of the base and support plates during sliding of the cover plate in and out of engagement with the connectors. The retainer may be a spring-loaded protrusion from the cover-plate work surface. In some of such embodiments, the end surface of one of the base and support plates defines a recess receiving the spring-loaded protrusion.

In some of the embodiments where the spanner wrench assembly has two support plates sandwiching the gripping portion of the base plate, the spanner wrench assembly may include two pairs of spaced apart elongate apertures and two pairs of corresponding connectors extending from one of the base and support plates.

In some examples, the connectors extend from the end surfaces of the support plates and the end surface of the base plate defines the recess for receiving the spring-loaded protrusion from the cover plate.

The spanner wrench assembly may further have a holder which retains the cover plate with respect to the base and support plates when the cover plate is disengaged therefrom. In some embodiments, the holder is a wire rope with one end attached to the cover plate and the other end secured with respect to the arcuate cavity. Such other end may be secured to a side surface of the base plate or the support plate.

DETAILED DESCRIPTION OF PREFERRED EMBODIMENTS

Figure 5:
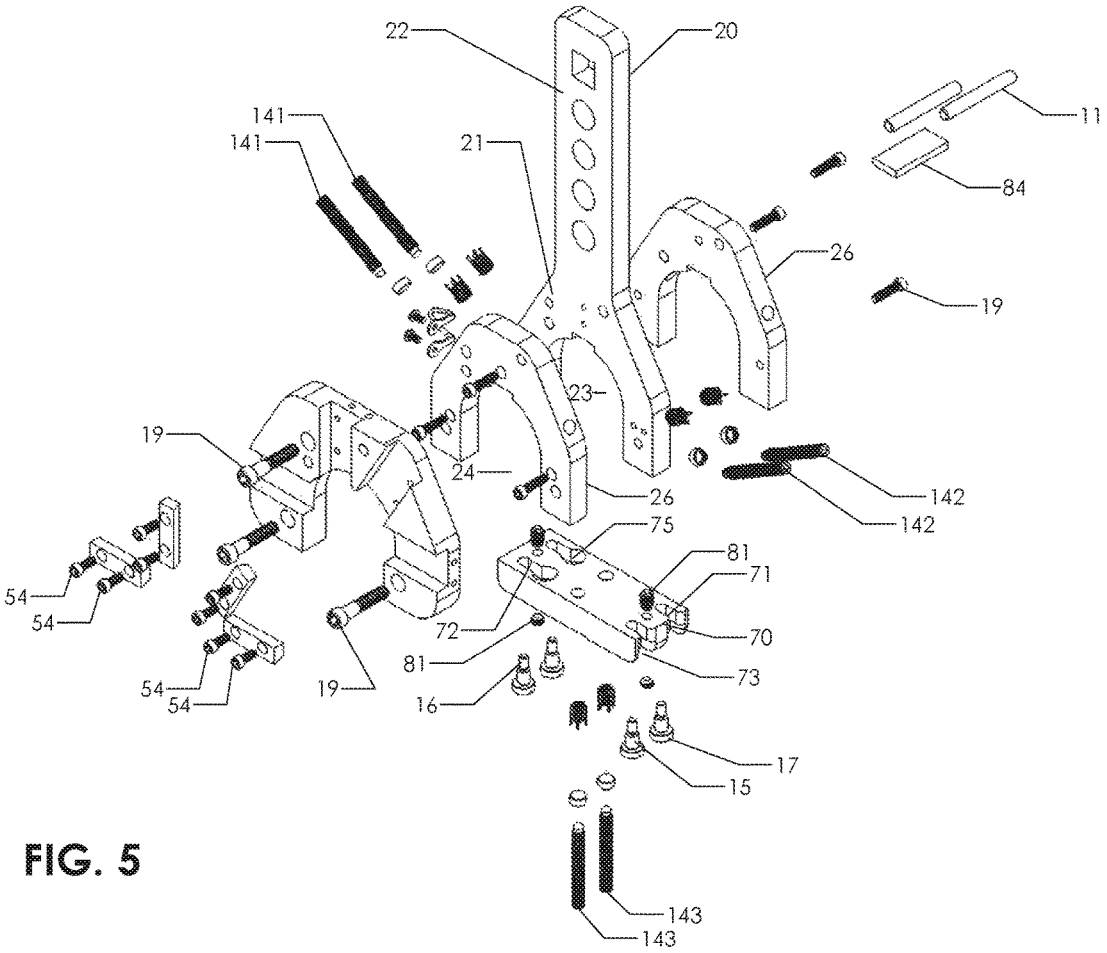
FIG. 5 is an exploded view of the spanner wrench assembly of FIG. 1.
Figure 6:
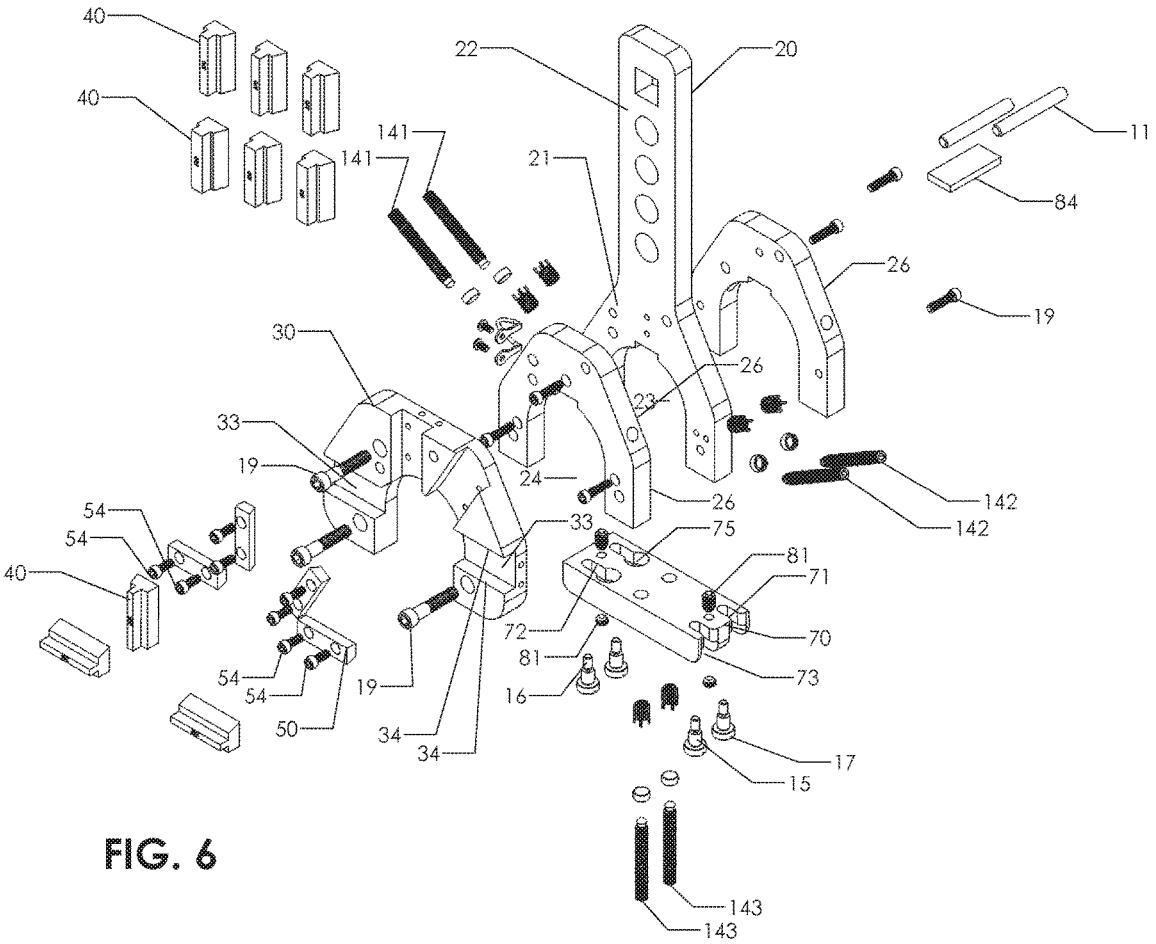
FIG. 6 is another exploded view of the spanner wrench assembly of FIG. 1, shown with three sets of exemplary engagement blocks.
Figure 8:
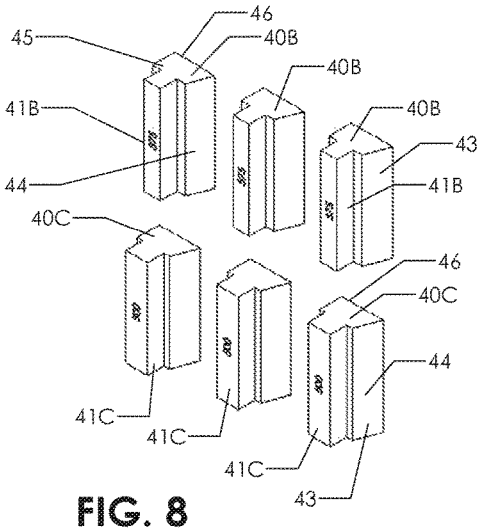
FIG. 8 is a perspective view of the other two sets of the engagement blocks with engagement portions of different sizes.
Figure 11:
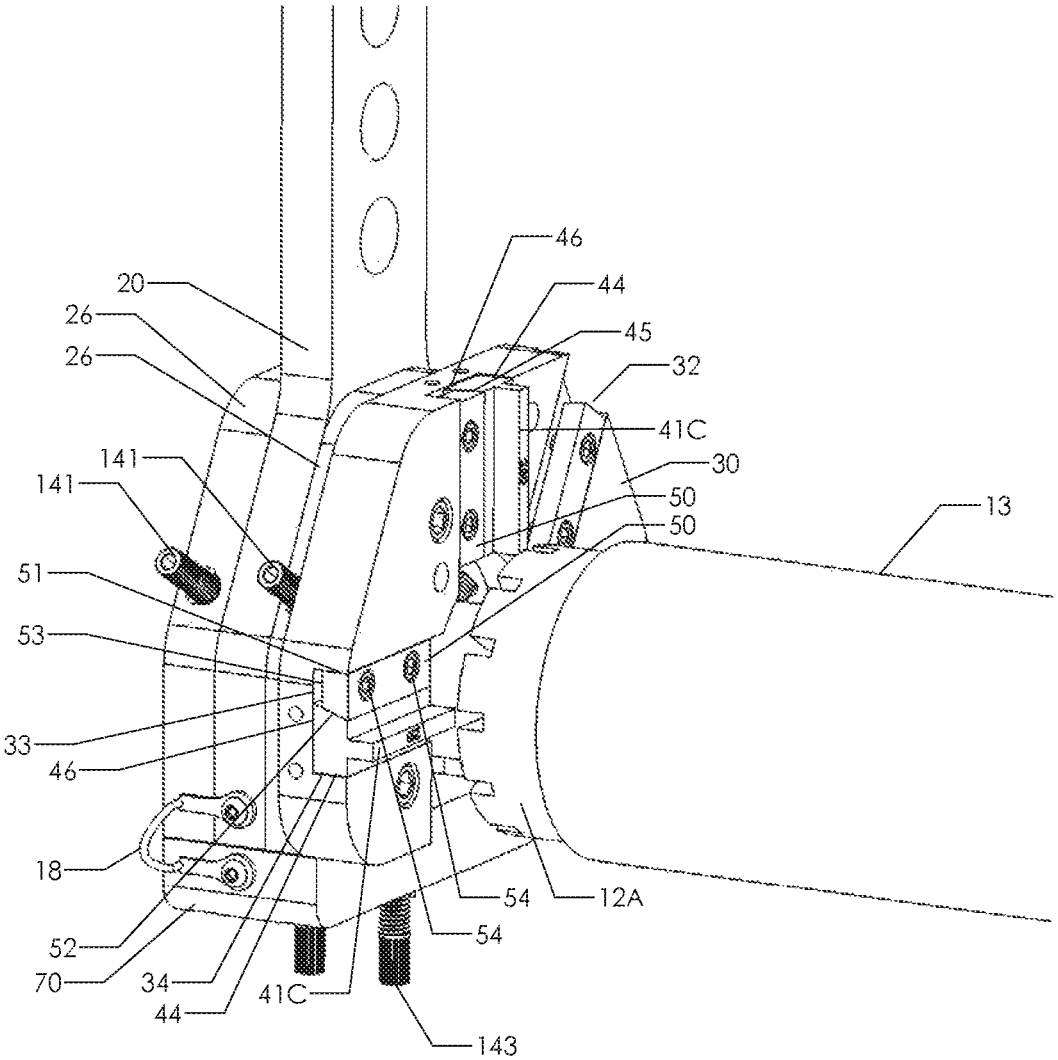
FIG. 11 is a fragmentary perspective view illustrating positioning of the spanner wrench assembly of FIG. 7 for removal of a component part from a structure by utilizing the engagement blocks of FIGS. 6-10.
Figure 13:
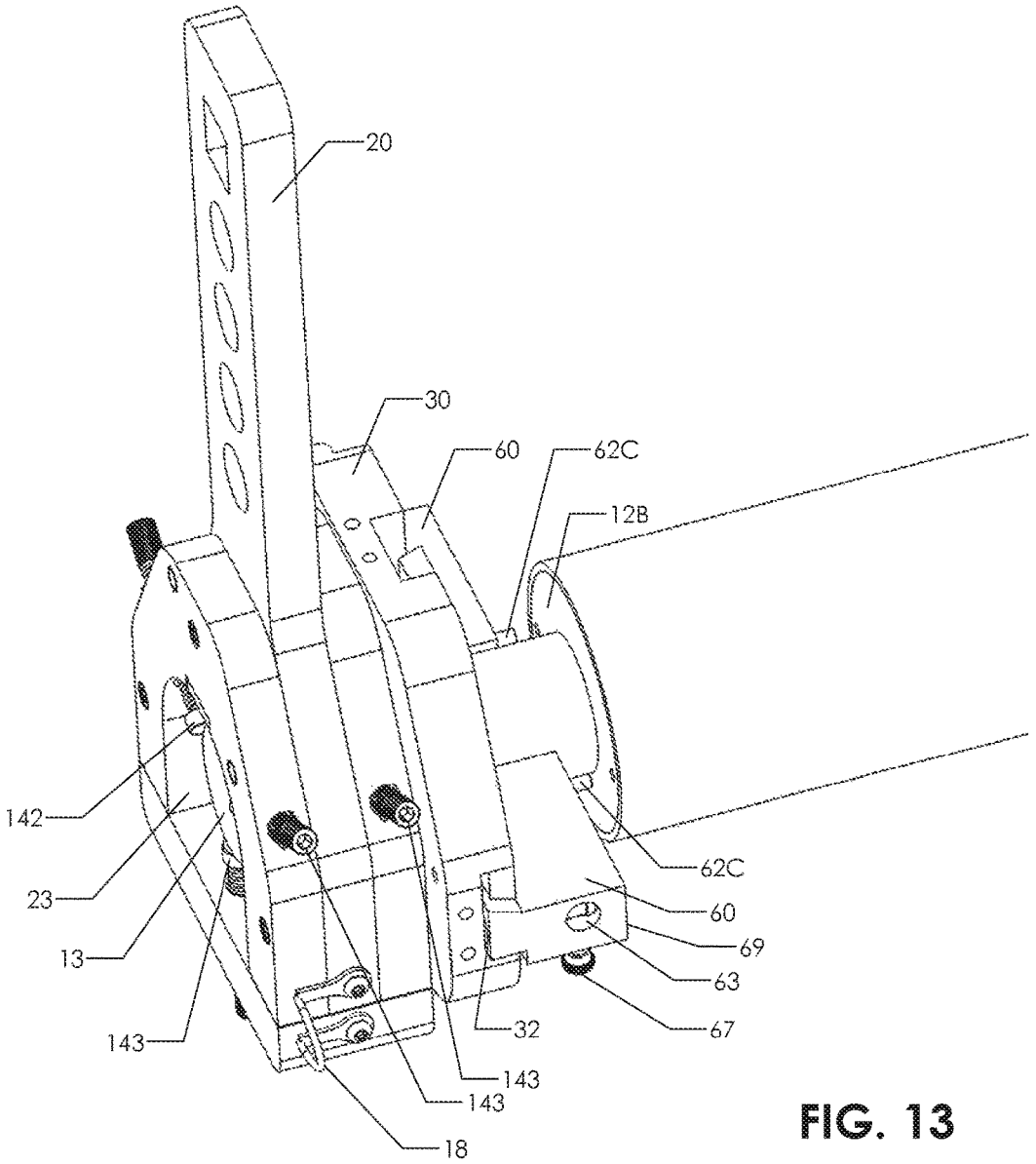
FIG. 13 is a fragmentary perspective view illustrating positioning of the spanner wrench assembly of FIG. 1 for removal of a component part from a structure by utilizing the pin-retaining blocks of FIG. 12 with working pins extending from their storage cavities.
Figure 14:
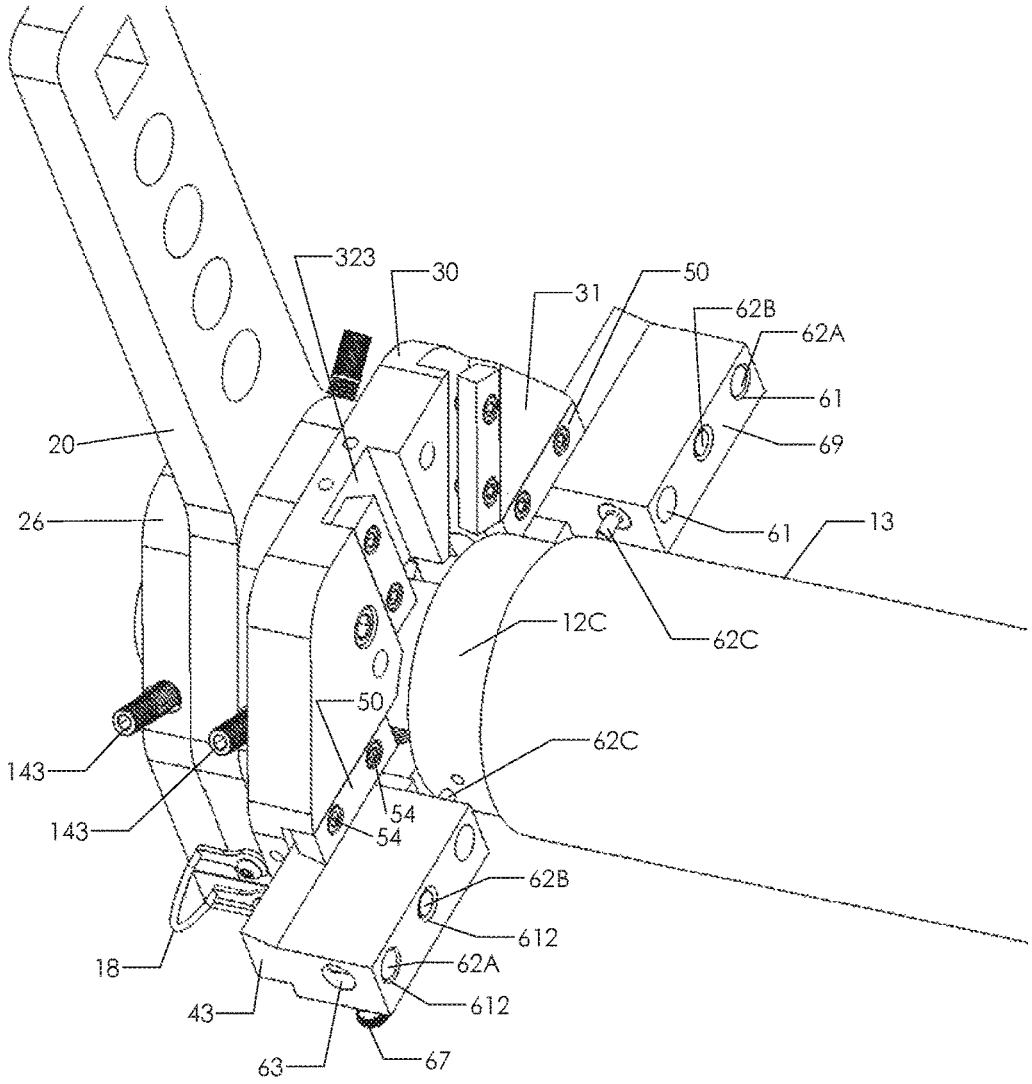
FIG. 14 is a fragmentary perspective view illustrating positioning of the spanner wrench assembly of FIG. 1 for removal of a component part from a structure by utilizing the pin-retaining blocks of FIG. 12 with working pins positioned orthogonally to their storage cavities.

FIGS. 1-11 illustrate an exemplary embodiment of an improved spanner wrench assembly 10 for installing and removing components 12 of a structure 13 such as a cap and a hydraulic cylinder. FIGS. 5 and 6 best show spanner wrench 10 having a base plate 20 with a gripping portion 21 extending from a handle portion 22 and defining an arcuate cavity 23 with an open end 24. A pair of support plates 26 is secured to gripping portion 21 and has a configuration substantially matching that of arcuate cavity 23. Support plates 26 may be made of material different from the material of base plate 20. The support-plate material may be of a lesser density and therefore lighter weight than the material of the base plate, such as aluminum and steel. An engagement plate 30 is secured to one of support plates 26 and has substantially matching configuration to that of arcuate cavity 23. FIGS. 11, 13 and 14 show engagement plate 30 providing locking engagement with components 12. Base plate 20 and support plate 26 may be connected with bolts 19 and/or pins 11 or otherwise attached together to form a rotation member 200 with handle portion 22 serving as a lever for torquing components 12. A rectangularly shaped non-metallic plastic plate 84 is positioned within the middle of arcuate cavity 23 and is configured to span all three of base plate 20 and support plates 26.

Figure 2:
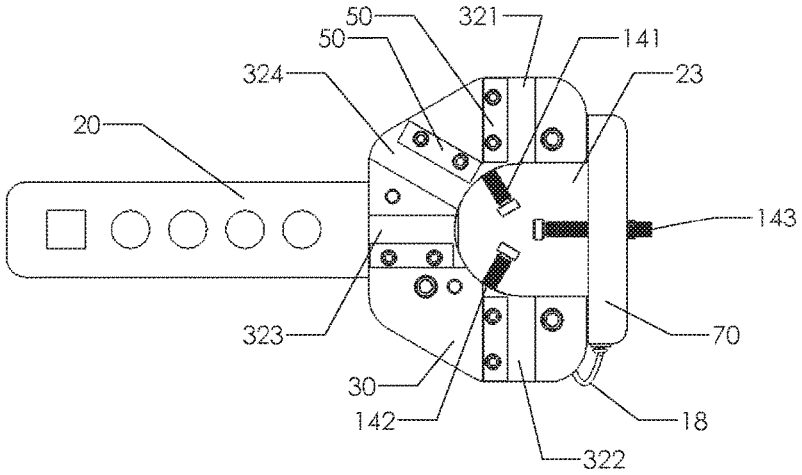
FIG. 2 is an engagement-plate side elevation view of the spanner wrench assembly of FIG. 1.
Figure 3:
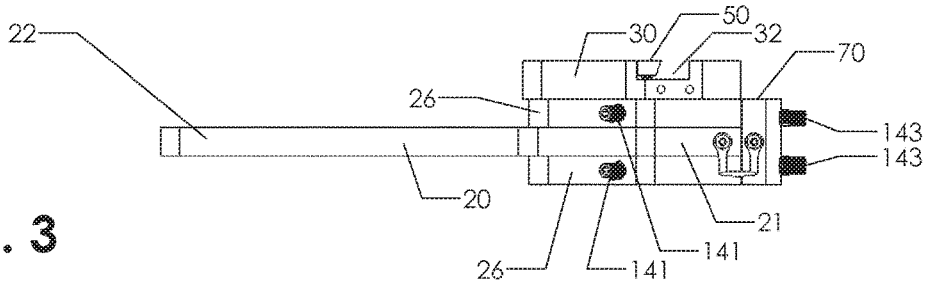
FIG. 3 is a lateral side elevation view of the spanner wrench assembly of FIG. 1.
Figure 4:
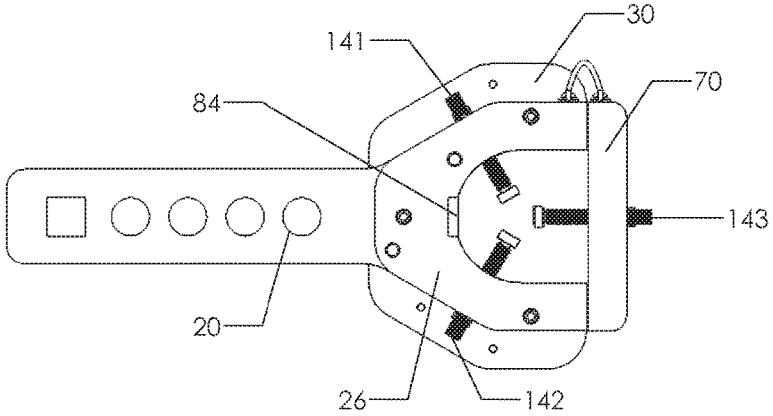
FIG. 4 is another side elevation view, opposite to the view of FIG. 2, of the spanner wrench assembly of FIG. 1.
Figure 9:
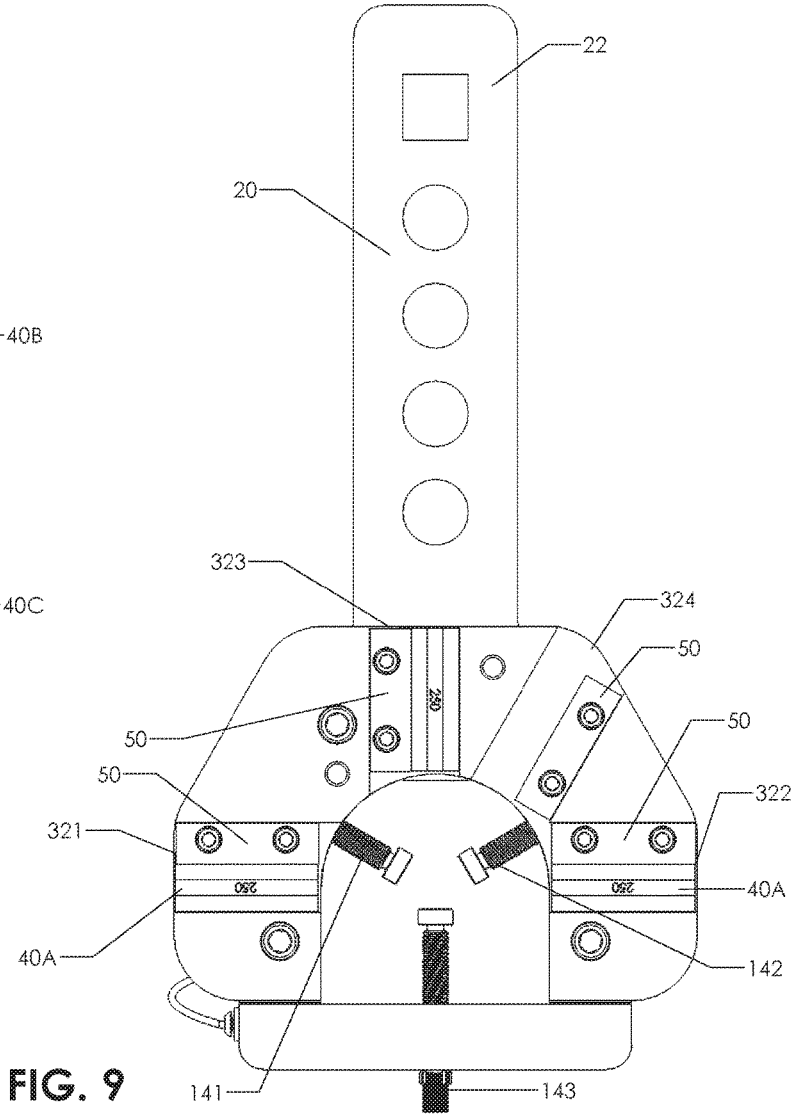
FIG. 9 is an elevation view of the engagement-plate side of the spanner wrench assembly of FIG. 7.

FIGS. 6-9 show spanner wrench assembly 10 having a plurality of engagement blocks 40*a*, 40*b* and 40*c*. Each block 40 is slidably received within a slot 32 formed in an open face 31 of engagement plate 30. FIGS. 2 and 9 best show slots 32 arranged such that slot 321 is positioned with respect to slot 322 at a 180° angle. Slot 323 is positioned with respect to slots 321 and 322 at a 90° angle. And slot 324 is positioned at a 60° angle with respect to slot 321, at a 30° angle with respect to slot 323 and at a 120° angle with respect to slot 322.

Figure 1:
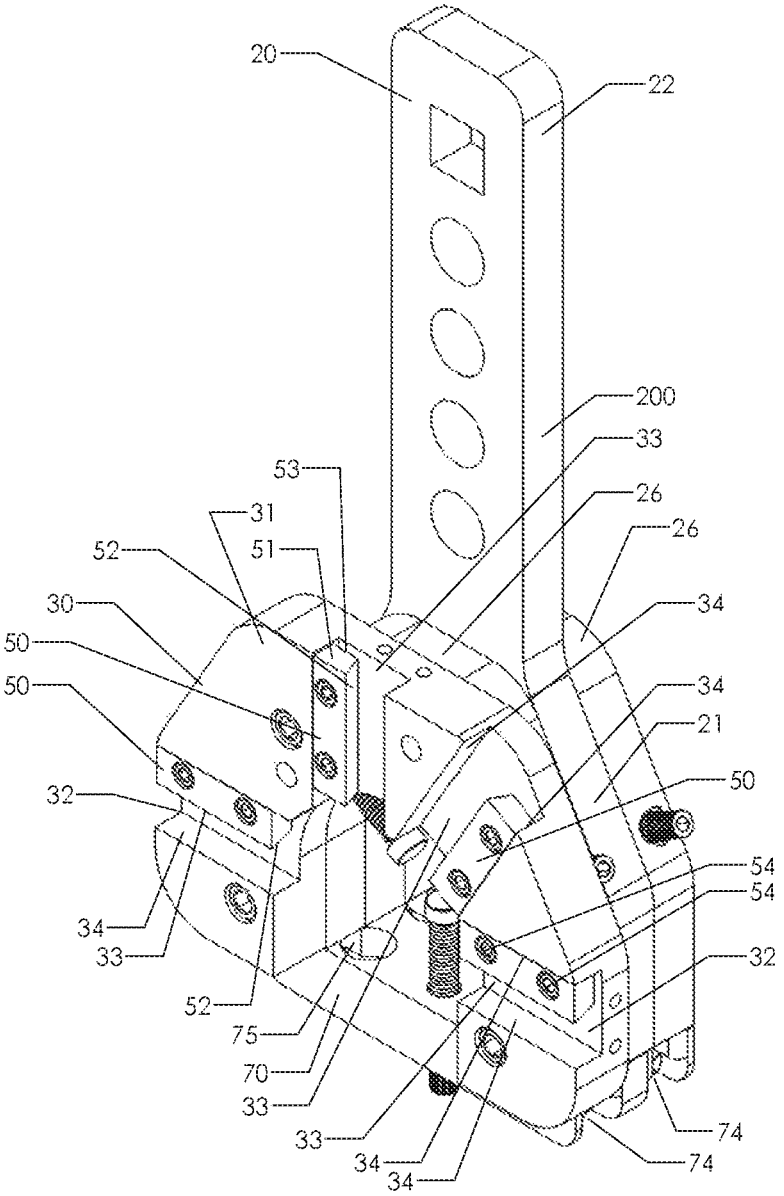
FIG. 1 is a perspective view of one embodiment of the improved spanner wrench assembly, shown from the open face of the engagement plate.
Figure 7:
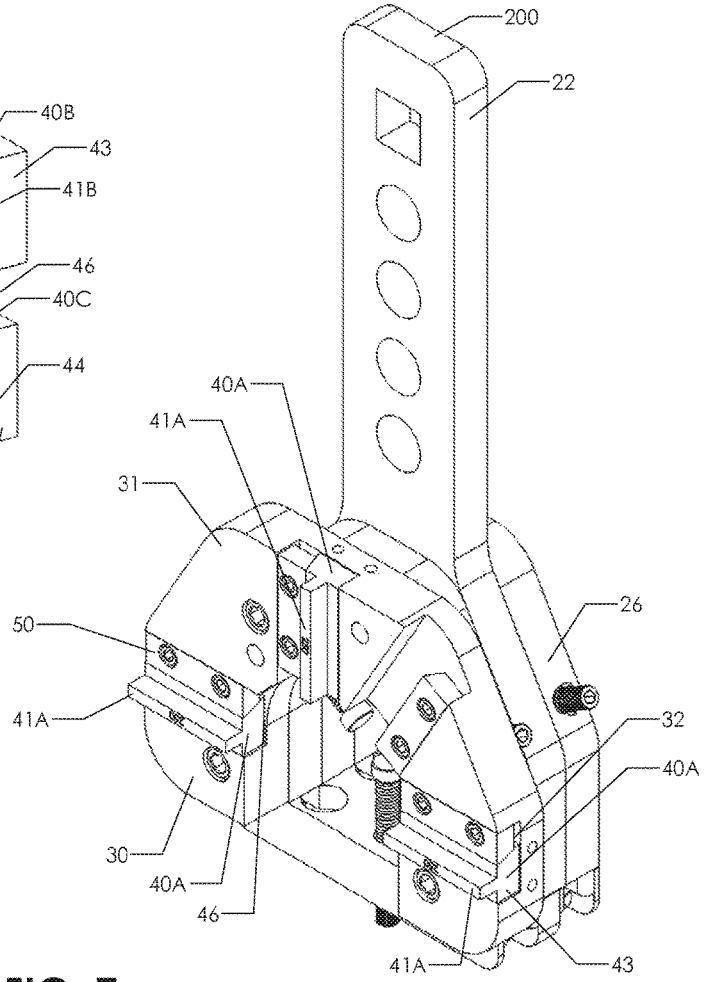
FIG. 7 is another engagement-plate side elevation view of the spanner wrench assembly of FIG. 1, shown with one of the sets of the engagement blocks locked in the engagement-plate open face.
Figure 10:
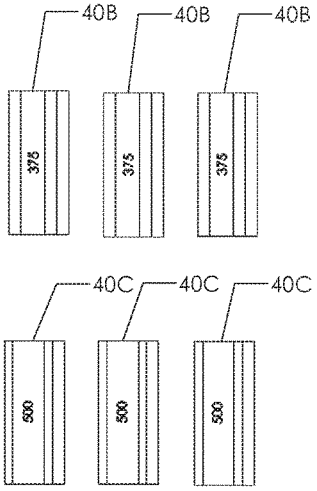
FIG. 10 is a plan view of the engagement blocks of FIG. 8.

FIG. 1 shows spanner wrench assembly 10 including a locking block 50 secured within each of slots 32. As seen in FIGS. 7 and 11, each locking block 50 is adjustable such that engagement blocks 40 may be substantially freely inserted into slots 32.

FIGS. 1 and 2 show each of slots 32 as a substantially rectangular trough defined by a substantially flat bottom surface 33 with a pair of opposite lateral surfaces 34 extending substantially orthogonally to bottom surface 33.

Each of engagement blocks 40 has an engagement portion 41 extending from a mounting portion 43 positionable within slot 32. Engagement portions 41 of different blocks 40*a*, 40*b* and 40*c* may be of different sizes to accommodate a variety of engagement cavities in components 12*a* to be removed. Mounting portion 43 has a pair of lateral surfaces 44 and 45 extending from a substantially flat mounting surface 46 positionable against less than the full width of substantially flat bottom surface 33 of slot 32. Lateral surface 44 of engagement-block mounting portion 43 is substantially orthogonal to mounting surface 46 for positioning against one of lateral surfaces 34 of slot 32. Lateral surface 45 of engagement block 40 extends from mounting surface 46 of block 40 at a sharp angle.

Locking block 50 has one lateral surface 51 substantially orthogonal to a bottom surface 53 for positioning against lateral surface 34 of slot 32 opposite orthogonal lateral surface 44 of engagement block 40. Lateral surface 52 of locking block 50 extends at an obtuse angle which substantially equals the subtraction from 180° of the sharp angle of lateral surface 45 of mounting portion 43 of engagement block 40.

In order to position engagement block 40 within slot 32, locking block 50 is moved away from bottom surface 33 of slot 32 by loosening fasteners 54 which secure locking block 50 to engagement plate 30. When engagement block 40 is in desired position, fasteners 54 are tightened such that angled lateral surface 52 of locking block 50 and mounting portion and angled lateral surface 45 of engagement block 40 are in tight abutment, thus holding the engagement block in the fixed position within the slot, as seen in FIGS. 7 and 11.

Figure 12:
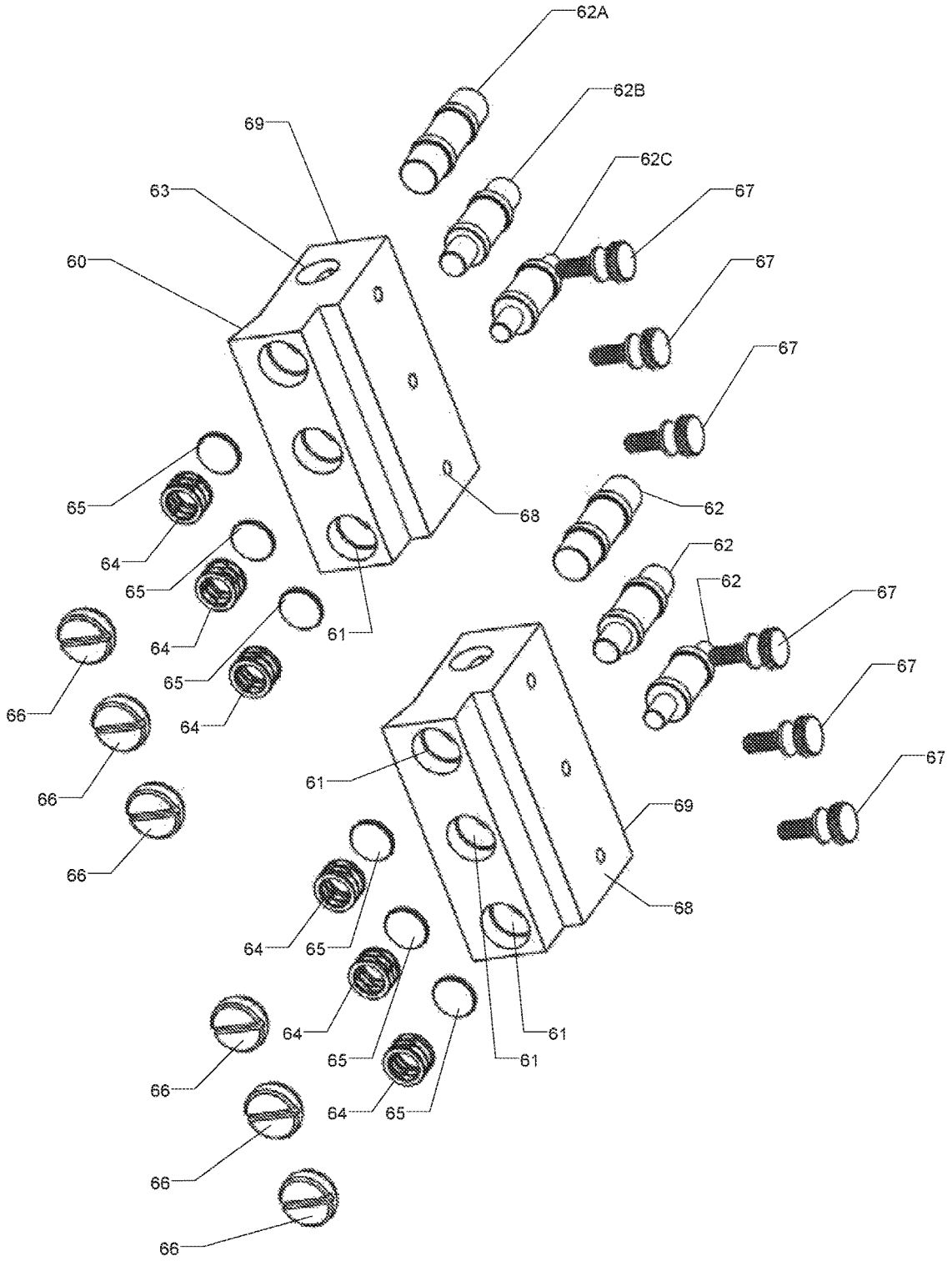
FIG. 12 is an exploded view of a pair of pin-retaining blocks.

FIGS. 12-14 illustrate a type of engagement blocks 30 which are pin-retaining blocks 60, each defining a set of cavities 61 with a retaining pin 62 in each cavity 61. As seen in FIG. 12, pin-retaining blocks 60 have a spring assembly within each cavity 61. The spring assembly includes a spring 64 positioned within cavity 61 between a pad 65 and a plug 66 which securely closes one cavity end 611. Pin 62 is positioned at the opposite open end 612 of cavity against pad 65. Spring 64 is compressed by pin 62 locked within cavity by a locking screw 67 which is advanced through a lateral wall 68 of block 60 into cavity 61 until engagement with pin 62. Pin 62 is unlocked by retrieval of locking screw 67 from cavity 61. The force created by the compression of spring 64 is released by the unlocking pin 62 and pushes pin 62 out of cavity 61 beyond a front face 69 of pin-retaining block 60 for engagement with component 12*b* to be removed from structure 13, as seen in FIG. 13. FIG. 14 shows pin 62 removed from storage cavity 61 and positioned onto an orthogonal cavity 63 to accommodate engagement with a component 12*c* that has a configuration requiring such engagement orientation.

Spanner wrench assembly 10 includes a cover plate 70 for closing open end 24 of arcuate cavity 23. FIGS. 5, 6 and 15-18 show cover plate 70 defining elongate apertures 71 and 72. Each of apertures 71 and 72 is dimensioned to accept a stem 16 of a corresponding one of a pair of connectors 15 extending from support plates 26. Aperture 71 extends to an open mouth portion 74 formed by an adjacent cover-plate end 73. Elongate apertures 72 each have a key-hole shape and extend to a closed mouth portion 75 dimensioned to accept a connector head 17 which is wider than elongate apertures 71 and 72.

FIGS. 15-18 show that in order to close arcuate cavity 23 and get a secure grip of component 12, cover plate 70 is secured with respect to rotation member 200. Cover plate 70 is slid against end surfaces 25 and 27 of base and support plates 20 and 26 such that connector head 17 is at an open cover-plate surface 76 which is opposite a work surface 77 abutting end surfaces 25 and 27 of rotation member 200.

Figure 15:
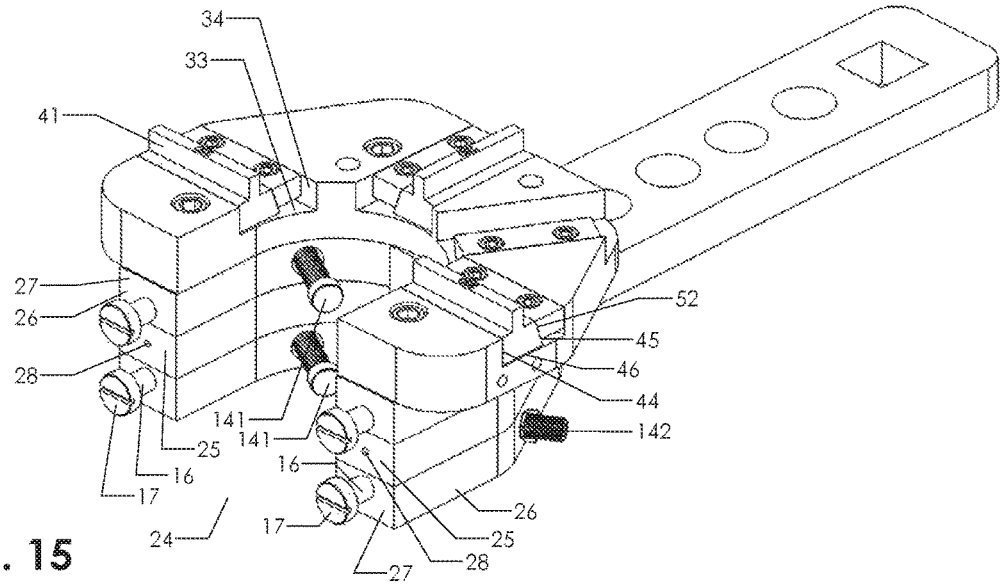
FIG. 15 is a fragmentary perspective view of the spanner wrench assembly of FIG. 1 with an open arcuate cavity, showing end surfaces of the base and support plates.
Figure 17:
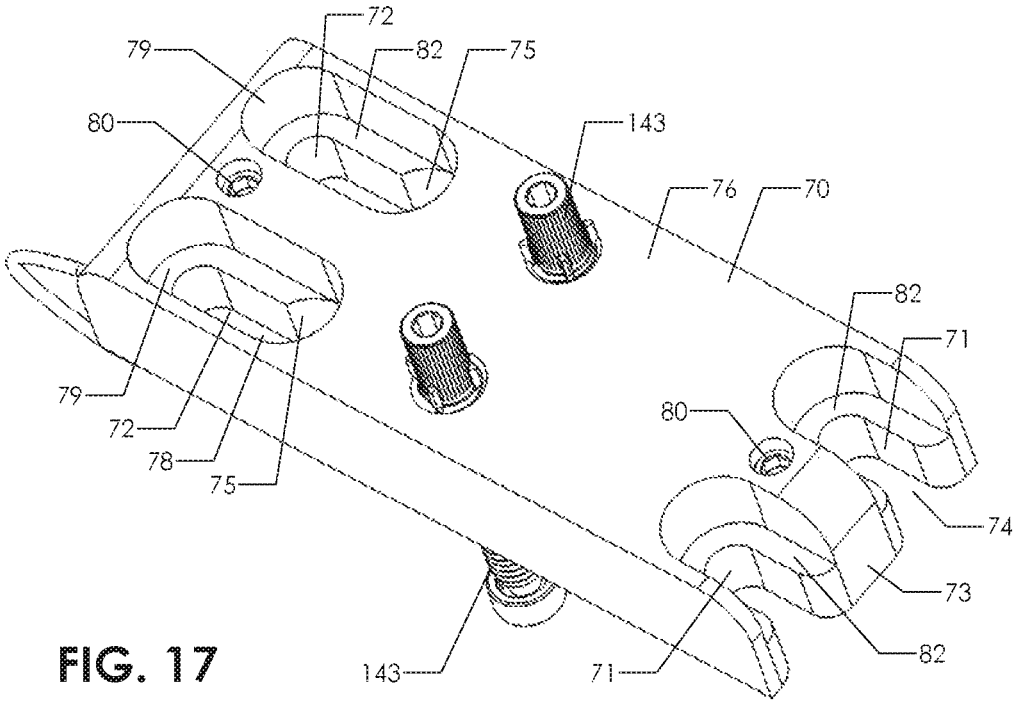
FIG. 17 is a perspective view of the open surface of the cover plate.
Figure 18:
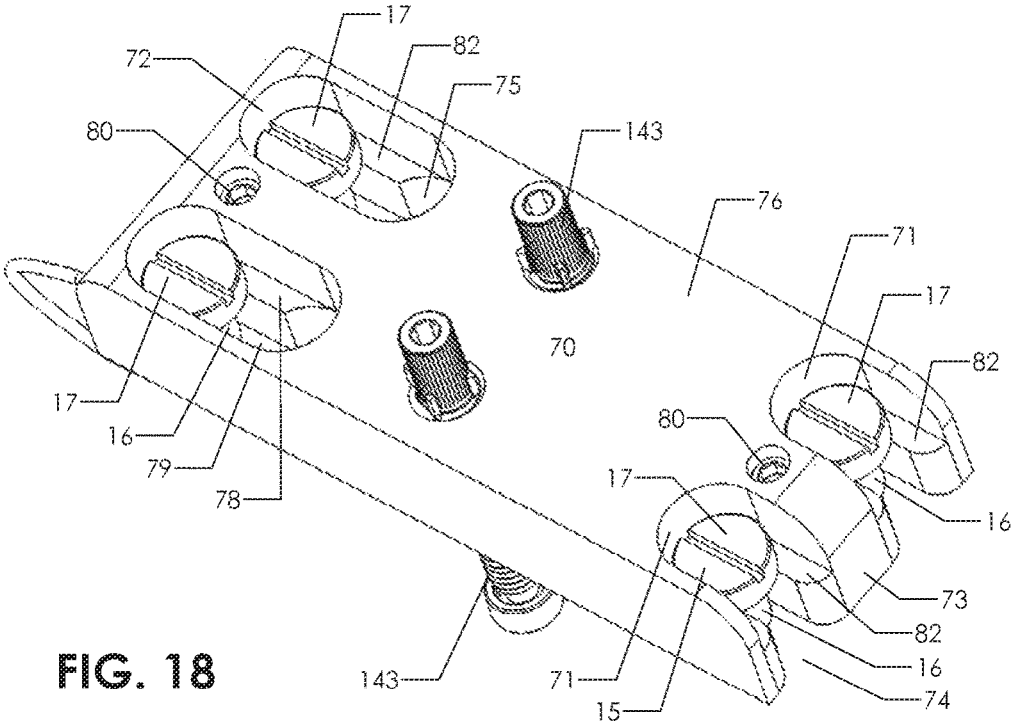
FIG. 18 is a perspective view of the cover plate from the open surface, showing the connectors retained in the apertures.
Figure 19:
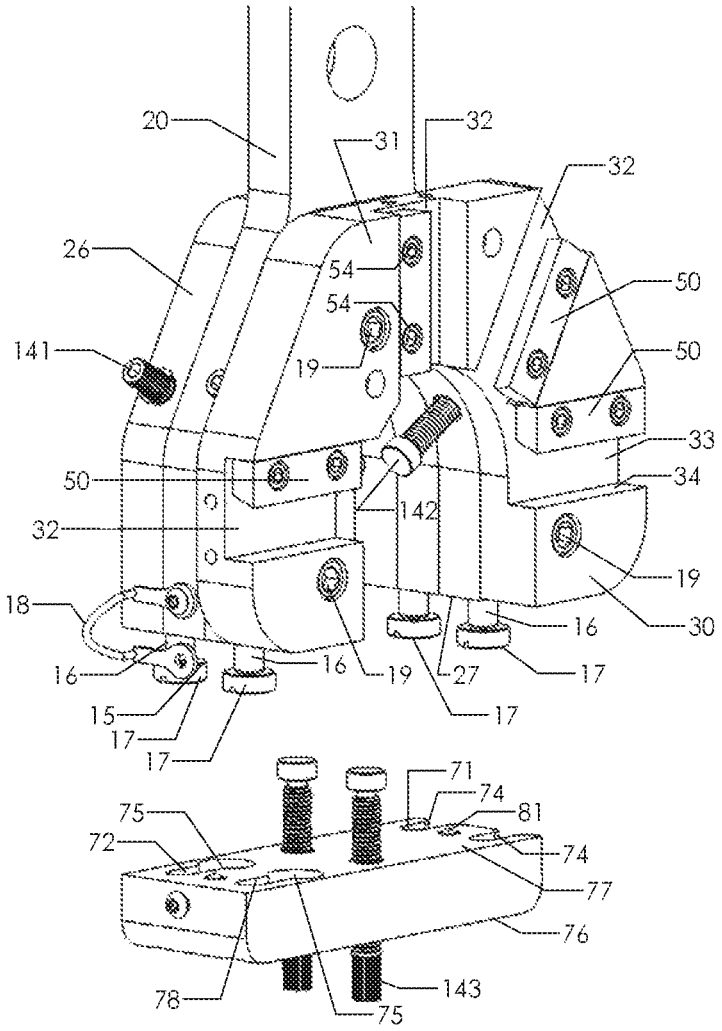
FIG. 19 is a fragmentary perspective view showing the cover plate positioned for closing the open end of the arcuate cavity.

FIGS. 15, 17 and 18 show narrow elongate portions 78 of apertures 71 and 72 formed through less than the full thickness of cover plate 70 such that the remaining thickness defines an elongate cavity 79 dimensioned to accept connector head 17. Such configuration forms a ledge 82 within elongate cavity 79 with connector head 17 being recessed within cover plate 70 against ledge 82 when cover plate 70 closes arcuate cavity 23.

Figure 16:
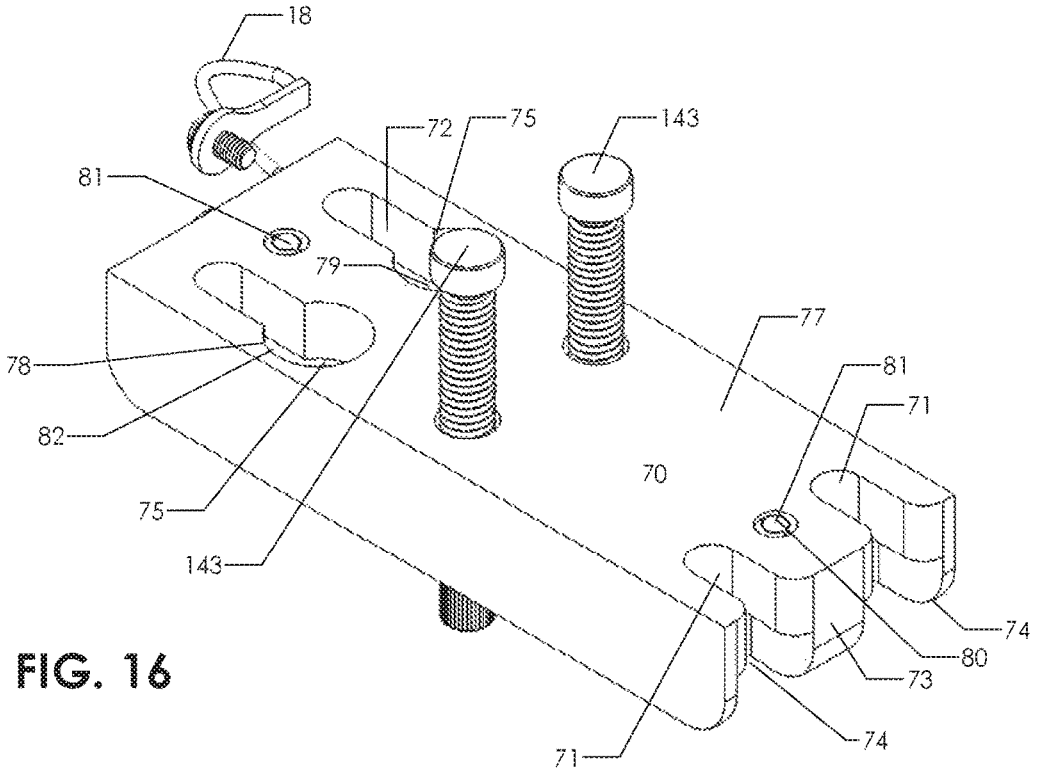
FIG. 16 is a perspective view of the work surface of the cover plate.

FIGS. 5, 6, and 16-18 show a retainer 80 at cover-plate work surface 77. During sliding of cover plate 70 in and out of engagement with connectors 15, retainer 80 can be pressed into cover plate 70 beyond work surface 77 by abutment of cover-plate work surface 77 and end surfaces 25 and 27 of base and support plates 20 and 26 of rotation member 200. FIG. 16 shows retainer 80 as a spring-loaded ball 81 protruding from cover-plate work surface 77. FIG. 15 shows end surfaces 25 of base plate 20 defining a recess 28 receiving spring-loaded ball protrusion 81 to further secure the position of cover plate 70 closing arcuate cavity 23.

When cover plate 70 is disengaged from rotation member 200, a holder 18 retains cover plate 70 with respect to base and support plates 20 and 26. FIGS. 2, 11, 13 and 14 show holder 18 as a wire rope with one end attached to cover plate 70 and the other end secured to a side surface 29 of base plate 20.

FIGS. 11, 13 and 14 show spanner wrench assembly 10 on a piston rod 13 prior to engagement with the threaded cap member 12. Adjustable contact pins 141, 142 and 143 have been adjusted to center wrench assembly 10 on rod structure 13. Prior to applying a force to handle portion 22, contact pins are adjusted to keep the wrench assembly 10 square with the rod 13 and to keep the wrench assembly 10 from "cocking" or twisting. Some embodiments may include a leveling device such as those utilizing a bubble level or some other indicator mechanism that facilitates the centering of wrench assembly 10 on rod structure 13.

While the principles of the invention have been shown and described in connection with specific embodiments, it is to be understood that such embodiments are by way of example and are not limiting.

The invention claimed is:

1. A spanner wrench assembly for installing and removing components of a structure, comprising:

a base plate having a gripping portion extending from a handle portion and defining an arcuate cavity with an open end;

at least one support plate secured to the gripping portion and substantially matching a configuration of the arcuate cavity, the at least one support plate being of a lesser density material than the base plate; and an engagement plate substantially matching the configuration of the arcuate cavity, the engagement plate being secured with respect to the at least one support plate and providing locking engagement with the components, the engagement plate defining a plurality of slots each slidably receiving one of a plurality of engagement blocks, at least one of the slots being positioned with respect to at least one other slot at one of 180°, 120°, 90°, 60° and 30° angles.

2. The spanner wrench assembly of claim 1 comprising a pair of the support plates each secured to the base plate and sandwiching the gripping portion therebetween, each of the support plates being of a lesser density material than the base plate, thereby reducing the total weight of the spanner wrench assembly.

3. The spanner wrench assembly of claim 1 further comprising a locking block secured within each of the slots and being adjustable such that the corresponding one of the engagement blocks is locked in a fixed position within the corresponding slot.

4. The spanner wrench assembly of claim 1 comprising a cover plate for closing the open end of the arcuate cavity, the cover plate defining a pair of spaced apart elongate apertures dimensioned to accept a stem of a corresponding one of a pair of connectors extending from one of the base and support plates, one of the elongate apertures extending to an open mouth portion formed by an adjacent cover-plate end, another of the elongate apertures extending to a closed mouth portion dimensioned to accept a connector head which is wider than the elongate apertures, thereby securing the cover plate with respect to the base and support plates.

5. The spanner wrench assembly of claim 4 further comprising a retainer at a cover-plate work surface, the retainer being pressable into the cover plate by abutment of the cover-plate work surface and end surfaces of the base and support plates during sliding of the cover plate in and out of engagement with the connectors.

6. The spanner wrench assembly of claim 5 wherein:

the retainer is a spring-loaded protrusion from the cover-plate work surface; and the end surfaces of one of the base and support plates define a recess receiving the spring-loaded protrusion.

7. The spanner wrench assembly of claim 5 further comprising a holder securing the cover plate with respect to the base and support plates when the cover plate is disengaged therefrom.

8. The spanner wrench assembly of claim 1 wherein:

the engagement blocks comprise pin-retaining blocks each defining a set of cavities with a retaining pin in each cavity; and a spring assembly within each cavity and including a spring depressed by the pin locked within the cavity such that unlocking of the pin releases the spring pushing the pin beyond a front face of the pin-retaining block for engagement with the component to be removed from the structure.

9. The spanner wrench assembly of claim 8 wherein the pin is locked within the cavity by a locking screw advanced through a lateral wall of the block into the cavity until engagement with the pin which is unlocked by retrieval of the locking screw from the cavity.

10. The spanner wrench assembly of claim 8 further comprising a locking block secured within each of the slots and being adjustable such that the corresponding one of the engagement blocks is locked in a fixed position within the corresponding slot.

11. A spanner wrench assembly for installing and removing components of a structure, comprising:

a base structure having a gripping portion extending from a handle portion and defining an arcuate cavity with an open end;

an engagement plate substantially matching the configuration of the arcuate cavity, the engagement plate being secured with respect to the base structure; and a cover for closing the open end of the arcuate cavity and a retainer at a work surface of the cover, the retainer being pressable into the cover by abutment of the work surface of the cover and end surfaces of the base structure during sliding the cover in and out of engagement with connectors extending from end surfaces of at least one support plate, thereby securing the cover with respect to the base and the at least one support plate.

12. The spanner wrench assembly of claim 11 wherein the cover defining a pair of spaced apart elongate apertures is dimensioned to accept a stem of a corresponding one of the connectors extending from the end surfaces of the at least one support plate, one of the elongate apertures extending to an open mouth portion formed by an adjacent end of the cover, another of the elongate apertures extending to a closed mouth portion dimensioned to accept a connector head which is wider than the elongate apertures.

13. The spanner wrench assembly of claim 12 wherein:

the retainer is a spring-loaded protrusion from the work surface of the cover; and the end surfaces of one of the base and support plates define a recess receiving the spring-loaded protrusion.

14. The spanner wrench assembly of claim 13 further comprising a holder securing the cover with respect to the base structure when the cover is disengaged therefrom.

15. A spanner wrench assembly for installing and removing components of a structure, comprising:

a base structure having a gripping portion extending from a handle portion;

an engagement plate substantially matching the configuration of the gripping portion of the base structure and being secured with respect thereto;

pin-retaining blocks secured with respect to an open face of the engagement plate defining a plurality of slots each slidably receiving one of the pin-retaining blocks, each block defining a set of cavities each retaining one pin; and a locking block secured within each of the slots and being adjustable such that the corresponding one of the pin-retaining blocks is locked in a fixed position within the corresponding slot.

16. The spanner wrench assembly of claim 15 wherein the pin is locked within the cavity by a locking screw advanced through a lateral wall of the block into the cavity until engagement with the pin which is unlocked by retrieval of the locking screw from the cavity.

17. The spanner wrench assembly of claim 15 wherein at least one of the slots is positioned with respect to at least one other slot at one of 180°, 120°, 90°, 60° and 30° angles.

18. The spanner wrench assembly of claim 15 further comprising a spring assembly within each cavity and including a spring depressed by the pin locked within the cavity such that unlocking of the pin releases the spring pushing the pin beyond a front face of the pin-retaining block for engagement with the component to be removed from the structure.

* * * * *